US007055534B2

(12) United States Patent
Goode et al.

(10) Patent No.: US 7,055,534 B2
(45) Date of Patent: Jun. 6, 2006

(54) GOLF GRIP CLEANING WIPE

(75) Inventors: Scott R. Goode, Columbia, SC (US); Paul Rawl, Lexington, SC (US)

(73) Assignee: Grip Clean LLP, Columbia, SC (US)

( * ) Notice: Subject to any disclaimer, the term of this patent is extended or adjusted under 35 U.S.C. 154(b) by 0 days.

(21) Appl. No.: 10/910,364

(22) Filed: Aug. 4, 2004

(65) Prior Publication Data

US 2005/0032665 A1 Feb. 10, 2005

Related U.S. Application Data

(60) Provisional application No. 60/492,302, filed on Aug. 5, 2003.

(51) Int. Cl.

| | |
|---|---|
| ***C11D 3/20*** | (2006.01) |
| ***C11D 3/37*** | (2006.01) |
| ***C11D 3/43*** | (2006.01) |
| ***B08B 3/04*** | (2006.01) |

(52) U.S. Cl. ..... 134/22.19; 134/25.4; 134/39; 134/42; 510/101; 510/241; 510/244; 510/337; 510/365; 510/407; 510/432; 510/438; 206/204

(58) Field of Classification Search ..... 510/101, 510/241, 244, 337, 365, 407, 432, 438; 206/204; 134/22, 19, 25.4, 39, 42
See application file for complete search history.

(56) References Cited

U.S. PATENT DOCUMENTS

| | | | | |
|---|---|---|---|---|
| 5,895,504 | A * | 4/1999 | Sramek et al. | 8/137 |
| 6,110,295 | A * | 8/2000 | Lu et al. | 134/42 |
| 6,566,316 | B1 * | 5/2003 | Hiatt et al. | 510/201 |
| 6,835,701 | B1 * | 12/2004 | Seipel et al. | 510/143 |
| 2002/0053356 | A1 * | 5/2002 | Gonzalez | 134/40 |
| 2005/0032665 | A1 * | 2/2005 | Goode et al. | 510/407 |

FOREIGN PATENT DOCUMENTS

| | | | |
|---|---|---|---|
| JP | 59204700 | * | 11/1984 |

* cited by examiner

*Primary Examiner*—Brian P. Mruk
(74) *Attorney, Agent, or Firm*—Nath & Associates PLLC; Gregory B. Kang; Jerald L. Meyer

(57) ABSTRACT

Articles, solutions, and methods for enhancing the grasping of and cleaning athletic equipment grips, in particular a golf club grip. These articles, solutions, and methods preferably comprise a water miscible solvent, a cleaning agent, and water to removes dirt, perspiration, water, and dried skin oils that have accumulated on the grip during the normal course of participating in athletic activity, while cleaning, drying, and restoring the natural tackiness of the grip.

18 Claims, No Drawings

GOLF GRIP CLEANING WIPE

This application claims the benefit of U.S. Provisional Patent Application Ser. No. 60/492,302 filed Aug. 5, 2003, the contents of which are hereby incorporated by reference in their entirety.

FIELD OF THE INVENTION

The present subject matter relates generally to articles, solutions, and methods for enhancing the grasping of and cleaning an athletic equipment grip, in particular a golf club grip.

BACKGROUND OF THE INVENTION

Various types of athletic equipment such as rackets, clubs, bats, handle bars, and the like all require gripping by the user of the equipment. For example, a golf club includes a head, shaft, and grip. The grip serves as the interface between the golfer's muscles and the golf club. Most grips are tacky to allow the golfer to hold the club more securely, thus increasing the accuracy of a hit ball's flight and the precision of its trajectory. The grip must not be slippery if the club is to perform the intended role of propelling the ball.

As golfers swing, the golf club grips become dirty and greasy, and they lose their tackiness over time. They also age and harden, so replacement of grips becomes necessary on a periodic basis. Since the ability of the grips to provide adequate performance can be extended to longer time intervals by regular cleaning, various cleaning implements for these athletic equipment grips have previously been used.

However, in the past it has been difficult to clean these grips because cleaning with water and soaps tends to remove the tackiness of the grip, leaving the grip slick and undesirable, as shown by U.S. Pat. No. 4,946,510. One previous solution to this problem was to wipe the grip with a towel to clean the grip. For example, U.S. Pat. No. 2,754,532 discloses a sportsman towel which is employed to clean sports equipment. However, merely wiping the grip with a towel often does not effectively clean the grip and may even work grime and dirt into the grip, thereby aggravating the condition.

Accordingly, numerous devices have been proposed in the prior art for cleaning the grips of athletic equipment. For example, U.S. Pat. No 4,554,696 describes electrically-driven brushes that scrub the grip of an athletic equipment clean. Similarly, U.S. Pat. Nos. 4,676,839 and 4,750,230 describe electrically powered automated golf grip cleaners. Likewise, U.S. Pat. No. 5,765,233 discloses a disposable club head wiping patch that is fastened to a golfer's trousers; U.S. Pat. No. 4,897,892 describes a machine that uses brushes to clean golf club grips; U.S. Pat. No. 5,426,806 describes a fluid-filled device in which the insertion of a golf club activates a pump that floods the grip with cleaning fluid; U.S. Pat. No. 5,644,277 describes a vertical pipe filled with a cleaning solution fabricated with internal bristles that can be used to clean a golf club grip; and U.S. Pat. No. 6,115,874 describes a device for roughening a worn or smooth grip to restore the initial texture and "feel" thus lengthening the time interval between grip replacement. However, all of these disclosed prior art devices have the drawback that they are bulky, do not clean golf club grips very well, and are not very portable, making them difficult to transport, use, and operate on the golf course.

Likewise, U.S. Pat. No. 4,946,510 discloses various chemicals including anhydrous sodium metasilicate, sodium tripolyphosphate, ether, sodium xylene sulfate, caustic soda, surfactants, and water combined in a 30-gallon container into which the golf grip would be inserted and manipulated. However, the same difficulties as noted above apply to this proposed solution as well.

Numerous cleaning compositions have previously been described for a plethora of objects and materials including glass, bricks, floors, clothing, and painted surfaces. In theory, these cleaning compositions can be used to clean a golf grip. For example, it has previously been proposed to use a multistep process that employed a soap, detergent, or abrasive to clean a grip, followed by a rinse step, further followed by drying with an absorbent towel. However, such a method is time consuming and the elapsed time before a club can be used is often several hours. Accordingly, these methods cannot be performed during the course of playing golf since golfers are required (USGA Rule 6–7) to play without undue delay. In competition, a committee sets pace of play guidelines including maximum periods of time allowed to complete a stipulated round, a hole or a stroke. Since the time to complete a stroke is invariably less than the time allotted to look for a lost ball, defined as 5 minutes by Rule 27, a multistep method that involves drying the grip cannot be employed if the intent is to clean the grips during play.

One proposed solution to these problems is disclosed by U.S. Pat. No. 6,048,612, which describes transferring a sticky, adhesive material from a carrier such as a towel to an athletic grip. The grip will retain some of the sticky adhesive material to increase tackiness and the bond between the hand and the athletic grip. However, this patent only discloses adding an adhesive material to a grip, and does not disclose cleaning a grip by removing dirt and grime, for example. Further, the solution proposed by this patent has not yet proven to be effective.

Accordingly, there is a need for an effective, easy, portable athletic equipment grip cleaner, particularly a golf club grip cleaner. The present subject matter addresses this need.

SUMMARY OF THE INVENTION

The present subject matter allows an athlete to clean the grip of athletic equipment with a quick-drying mixture of chemicals that removes dirt, perspiration, water, and dried skin oils that have accumulated during the normal course of participating in athletic activity. The chemicals clean, dry, and restore the natural tackiness of the grips.

In a preferred embodiment, the present subject matter relates to an article for cleaning an athletic equipment grip. The article comprises a carrier material and a solution applied to the carrier material. That is, the carrier material is pre-moistened with the solution. The solution preferably comprises about 5–95% by volume of a water miscible solvent, about 0.01–10% by volume of a cleaning agent, and the balance water.

In another preferred embodiment, the present subject matter relates to a solution for cleaning an athletic equipment grip. The solution comprises about 5–95% by volume of a water miscible solvent, about 0.01–10% by volume of a cleaning agent, and the balance water. The solution is uniquely formulated to permit cleaning of an athletic equipment grip, such as a golf club grip.

In still another preferred embodiment, the present subject matter relates to a method for cleaning a golf club grip. According to this method, a solution is applied to the golf club grip in order to clean the grip. The applied solution comprises about 5–95% by volume of a water miscible solvent, about 0.01–10% by volume of a cleaning agent, and the balance water.

DETAILED DESCRIPTION OF THE INVENTION

The present subject matter relates to a solution, and a towelette pre-moistened with the same, that contains chemicals specifically formulated to remove dirt and grime from natural and composite athletic equipment grips. In a preferred embodiment, the solution and pre-moistened towelette are formulated to remove dirt and grime from natural and composite golf club grips.

Additionally, the present solution and pre-moistened towelette are capable of restoring the natural tackiness of athletic equipment grips, particularly golf club grips. In the process of gripping a golf club, a bond forms between the device and its user. That bond is maximized when the grip is clean and tacky and soft. Golfers refer to the "feel" of their grip to describe the softness and tackiness that is widely held to improve the golfers grip on the club and the resulting shot. The present subject matter allows the golfer to clean the grip at any time during the course of play quickly, inexpensively, and with minimum effort to restore and maximize this "feel" of the golf club grip.

Cleaning Solution

In one embodiment, the present subject matter relates to a cleaning solution uniquely formulated and designed for cleaning athletic equipment grips, particularly golf club grips, to restore natural grip tackiness and remove, e.g., built up dirt, grime, grease, oils, tar, and human sweat that has accumulated on the grip. In particular, the present cleaning solution preferably aids in cleaning oils and grease from a golf club grip. Accordingly, the present cleaning solution acts to rejuvenate a golf club grip. These cleaning solutions may achieve this cleaning effect in part by aiding in the dispersion of particles present on the golf club grip, thereby improving the action of particulates or solutes within the solution.

Accordingly, a preferred cleaning solution in this regard comprises about 5–95% by volume of a water miscible solvent, about 0.01–10% by volume of a cleaning agent, and the balance water.

Preferred, non-limiting examples of water miscible solvents useful in forming the present cleaning solutions are isopropyl alcohol, ethanol, acetone, and mixtures thereof. Isopropyl alcohol is particularly preferred in this regard. As such, the water miscible solvent is preferably 5–95% isopropyl alcohol. In a particularly preferred embodiment, the cleaning solution comprises about 50% by volume water miscible solvent, with the remainder of the solvent system being purified water. The solvent holds the other components in solution.

Preferred, non-limiting examples of cleaning agents useful in forming the present cleaning solutions are citrus oil, pine oil, detergent, soap, and mixtures thereof. Citrus oil is particularly preferred in this regard. As such the cleaning agent is preferably 0.01–5% citrus oil. The cleaning agent serves to cause dirt, mud, grease, grease stains, and other contaminants to be released from the golf club grip. These or other cleaning agents may also serve as grease cutting agents or tackiness agents to aid in rendering the golf club grip tacky. In this regard, traces of the cleaning agent may provide additional tackiness to the golf club grip. In a preferred embodiment, the cleaning agent has a pleasant aroma.

In an especially preferred embodiment, the cleaning agent is about 5% by volume of a citrus oil solution (made from 5% limonene in solution with 4% propylene glycol, 2% tetrasodium EDTA, 10% butoxyethanol, 2% monoethanolamine, and 4% sodium hydroxide). In this regard, the citrus oil cleaning agent is dissolved at a concentration of 5% in an isopropyl alcohol/water solvent mixture. Another particularly preferred cleaning agent useful in this regard is a pine oil solution (made from 20% pine oil, 10% isopropyl alcohol, 8.8% tall oil, and 1.5% potassium hydroxide in water). In this regard, the pine oil cleaning agent is dissolved in an isopropyl alcohol/water solvent mixture.

In another preferred embodiment, the cleaning solution can additionally comprise a resinous material. This resinous material may serve as a tackifier or tackiness enhancer to aid in restoring tackiness to the golf club grip. As such, it would be expected that the resinous material is capable of remaining on the carrier material, or of being transferred in part to the golf club grip. For example, it would be expected that when a cleaning solution containing a resinous material is contacted to a golf club grip, a portion of the mixture coats the grip to provide a friction surface.

In a further preferred embodiment, the cleaning solution can additionally comprise a surfactant. The surfactants useful in the present cleaning solutions are preferably selected from the group consisting of an amphoteric surfactant, an anionic surfactant, a nonionic surfactant, a cationic surfactant, and mixtures thereof. In this regard, cocamidopropyl betaine is a preferred amphoteric surfactant useful herein, sodium lauryl sulfate is a preferred anionic surfactant useful herein, alkyl polyglycosides are preferred nonionic surfactants useful herein, and quaternary ammonium salts are preferred cationic surfactants useful herein. A nonionic surfactant is particularly preferred in this regard. It would be expected that the surfactant may reduce the surface tension between two liquids, such as oil and water, thereby producing a wetting, emulsifying, or detergent effect.

In another preferred embodiment, the cleaning solution can additionally comprise a pH adjusting agent. This pH adjusting agent ensures that the cleaning solutions herein maintain an overall pH effective for cleaning athletic equipment grips. In this regard, the pH adjusting agent ensures that the cleaning solution maintains a pH in the range of from about 8 to about 12. Ammonia and sodium and potassium hydroxides are preferred, non-limiting examples of pH adjusting agents useful herein.

In alternative embodiments, the cleaning solutions herein can additionally contain any of a further tacky adhesive, a thickener, and a wetting agent.

The cleaning solutions described herein may be applied to a golf club grip in order to effectively clean the grip using any method or apparatus readily known to those of ordinary skill in the art. Particularly preferred in this regard is the use of an article comprising a carrier material for delivering the cleaning solution to the golf club grip. The present cleaning solution can also be applied to a golf club grip by, without limitation, another apparatus, a device, dipping the grip into a reservoir of solution, a spray or aerosol applicator, a molded wafer forming an effervescent solution, cotton balls, cotton swabs, or a wick or saturated applicator.

Cleaning Article

Accordingly, the present subject matter additionally relates to an apparatus for cleaning athletic equipment grips, particularly golf club grips, to restore natural grip tackiness and remove, e.g., built up dirt, grime, grease, oils, tar, and human sweat that has accumulated on the grip. In this regard, the apparatus is intended as a delivery system to apply the above-described cleaning solution to the athletic equipment grip to be cleaned.

In this regard, in a preferred embodiment the present apparatus comprises a carrier material which is pre-moistened with the cleaning solution to clean, dry, and restore the natural tackiness of the golf club grip. Preferred carrier materials are safe to use, disperse easily, provide ready carriers for solutions, and are biodegradable. Such pre-moistened carrier materials are well known in the art and include, without limitation, cleaning tissues such as wet wipes, towelettes, and the like. These tissues may be prepared from paper or paper products which may be treated so as to improve their wet strength. These tissues may further be made from any other material commonly used, such as for example cotton, viscose, viscose polyester, viscose polyethylene, paper, or woven fabric.

In an alternative embodiment, the carrier material may be a dispersible and biodegradable wet wipe comprising a non-woven web of fibers that are pre-moistened with the cleaning solution. In this regard, the carrier material may be composed primarily of cellulose wood pulp fibers with an added amount of textile fibers to enhance wet and dry strength. The preferred textile or cloth fibers include rayon, cotton, wool, felt, linen, silk, polyester, nylon, acetate, or tencel fibers. The carrier materials used herein can be made from either natural or synthetic materials, such as those described by U.S. Pat. No. 6,287,582, the contents of which are hereby incorporated by reference in their entirety.

Such carrier materials can be prepared according to the knowledge readily available to those of skill in the art. For example, the carrier material can be prepared by carding, by wet laying, by spunbonding, or by melt blowing.

The carrier material, and thus the apparatus, must have a sufficient wet strength so that it does not disintegrate in the individual's hand upon application to an athletic equipment grip. The wet wipe can be evaluated according to a well known CDLT strength test, such as that described in U.S. Pat. No. 5,629,081, the contents of which are hereby incorporated by reference in their entirety.

The carrier materials used herein may be sized such that they are each useful for cleaning a single piece of athletic equipment, such as a golf club, and may be packaged in closed containers. In a preferred embodiment in this regard, the carrier materials herein are packaged premoistened in a package of 30 articles. Alternatively, the carrier materials may be individually packaged. In a preferred embodiment in this regard, the carrier materials herein are packaged pre-moistened in foil packages of 1–2 articles each.

Methods of Use

In another embodiment, the present subject matter relates to a method for cleaning athletic equipment grips, particularly golf club grips, to restore natural grip tackiness and remove, e.g., built up dirt, grime, grease, oils, tar, and human sweat that has accumulated on the grip. In this regard, the methods involve applying the above-described cleaning solution to the athletic equipment grip to be cleaned. The cleaning solution is preferably applied to the athletic equipment grip in the form of a pre-moistened towelette, as described above.

In preferred embodiments, the pre-moistened towelette is simply rubbed or contacted on a golf club grip or the gripping portion of other athletic equipment. The towelette will not adhere to the athletic grip, but will merely transfer a portion of the cleaning solution to the grip while they are in contact.

In this regard, the present methods preferably comprise removing a pre-moistened towelette from its container. Once the towelette has been removed, a user folds it or unfolds it to fit his or her hands, and then traverses the grip with modest pressure, repeating as needed. Debris, dried perspiration, and excess moisture are transferred to the towelette, and a small amount of tackiness-enhancer present in the cleaning solution is transferred to the grip. The chemicals are all miscible, so they do not accumulate on the grip. The process of cleaning a club is finished in several seconds and an entire bag of 14 clubs requires only 1–2 minutes.

EXAMPLES

The following examples are illustrative of the present subject matter and are not intended to be limitations thereon. All percentages are based on the percent by volume of the final cleaning solution or formulation prepared unless otherwise indicated and all totals equal 100% by volume.

Example 1

The following example illustrates a cleaning solution of the present subject matter:

475 L of water

475 L of isopropyl alcohol

50 L of citrus oil stock solution (5% limonene, 4% propylene glycol, 2% tetrasodium EDTA, 10% butoxyethanol, 2% monoethanolamine and 4% sodium hydroxide in water).

This cleaning solution can be prepared by adding the isopropyl alcohol and the water together. The citrus oil stock solution is then added to the solvents while mixing.

Example 2

The formulation of Example 1 was applied to a towelette carrier formed of paper by soaking the same in the formulation for a period of about 10 minutes. The thus formed pre-moistened towelette was then applied to a golf club grip. The golf club grip then could be tested for cleanliness and grasping qualities. It would be expected that the golf club grip would exhibit a marked cleaner appearance, and would possess a markedly improved graspability.

Example 3

The formulation of Example 1 was applied to a towelette carrier formed of paper by spraying the formulation on the towelette. The thus formed pre-moistened towelette was then applied to a golf club grip. The golf club grip then could be tested for cleanliness and grasping qualities. It would be expected that the golf club grip would exhibit a marked cleaner appearance, and would possess a markedly improved graspability.

The present subject matter being thus described, it will be apparent that the same may be modified or varied in many ways. Such modifications and variations are not to be regarded as a departure from the spirit and scope of the present subject matter, and all such modifications and variations are intended to be included within the scope of the following claims.

We claim:

1. A method for cleaning a golf club grip comprising:

applying a solution to the golf club grip, the solution comprising about 5–95% by volume isopropyl alcohol, about 0.01–10% by volume of a cleaning agent, and the balance water.

2. The method of claim 1, wherein a towelette premoistened with said solution is used to apply said solution to said golf club grip.

3. The method of claim 1, wherein said cleaning agent is selected from the group consisting of citrus oil, pine oil, ammonia, detergent, soap, and mixtures thereof.

4. The method of claim 3, wherein said cleaning agent is citrus oil present at about 0.01–5% by volume of the solution.

5. The method of claim 1, wherein said solution further comprises a pH adjusting agent.

6. The method of claim 1, wherein said solution further comprises a resinous material.

7. The method of claim 1, wherein said solution further comprises a resinous material and a pH adjusting agent.

8. The method of claim 1, wherein said cleaning agent is citrus oil present at about 0.01–5% by volume of the solution, and wherein said solution further comprises a resinous material and a pH adjusting agent.

9. The method of claim 8, wherein a towelette premoistened with said solution is used to apply said solution to said golf club grip.

10. The method of claim 1, wherein a towelette premoistened with said solution is used to apply said solution to said golf club grip.

11. A method for cleaning a golf club grip comprising:

applying a solution to the golf club grip, the solution comprising about 5–95% by volume of a water miscible solvent, about 0.01–10% by volume of a cleaning agent, a resinous material, and the balance water.

12. The method of claim 11, wherein said water-miscible solvent is selected from the group consisting of isopropyl alcohol, ethanol, acetone, and mixtures thereof.

13. The method of claim 11, wherein said cleaning agent is selected from the group consisting of citrus oil, pine oil, detergent, soap, and mixtures thereof.

14. The method of claim 13, wherein said cleaning agent is citrus oil present at about 0.01–5% by volume of the solution.

15. The method of claim 11, wherein said solution further comprises a pH adjusting agent.

16. The method of claim 11, wherein said cleaning agent is citrus oil present at about 0.01–5% by volume of the solution, and wherein said solution further comprises a pH adjusting agent.

17. The method of claim 16, wherein a towelette premoistened with said solution is used to apply said solution to said golf club grip.

18. The method of claim 11, wherein a towelette premoistened with said solution is used to apply said solution to said golf club grip.

* * * * *